United States Patent [19]

Smart

[11] Patent Number: 4,909,170

[45] **Date of Patent: * Mar. 20, 1990**

[54] SAILBOAT MAST ASSEMBLY

[75] Inventor: Frank N. Smart, Laguna Beach, Calif.

[73] Assignee: Sea Tek Incorporated., San Pedro, Calif.

[ * ] Notice: The portion of the term of this patent subsequent to May 30, 2006 has been disclaimed.

[21] Appl. No.: 307,620

[22] Filed: Feb. 7, 1989

Related U.S. Application Data

[63] Continuation-in-part of Ser. No. 93,785, Sep. 4, 1987, Pat. No. 4,834,013.

[51] Int. Cl.[4] ..... B63H 9/10

[52] U.S. Cl. ..... 114/90; 114/89

[58] Field of Search ..... 114/39.1, 89, 90; 52/721, 586

[56] References Cited

U.S. PATENT DOCUMENTS 534,397 2/1895 Lewis ..... 114/90

4,072,121 2/1978 Anderson et al. ..... 114/90

4,211,179 7/1980 Saunders ..... 114/90

4,834,013 5/1989 Smart ..... 114/90

FOREIGN PATENT DOCUMENTS 5645 of 1828 United Kingdom ..... 114/90

*Primary Examiner*—Sherman D. Basinger

*Assistant Examiner*—Edwin L. Swinehart

*Attorney, Agent, or Firm*—G. Joseph Buck

[57] ABSTRACT

A sailboat mast constructed of two extruded mast sections joined together by two joining sections. The joining sections have either wedge-shaped surfaces or wedge-shaped openings along their edges which mate with wedge-shaped openings or wedge-shaped surfaces at the edges of the mast sections. The mast sections and the joining sections are held together by a thin layer of glue located on the mating, wedge-shaped surfaces. Because of the wedge shapes, when the glue is applied and the mast sections and the joining sections are pressed together, the glue squeezes into a thin, uniform layer which provides a strong joint.

8 Claims, 4 Drawing Sheets

SAILBOAT MAST ASSEMBLY

CONTINUATION-IN-PART

This is a continuation-in-part of application Ser. No. 07/093,785 filed Sept. 4, 1987 now U.S. Pat. No. 4,834,013, issued May 30, 1989, for a Sailboat Mast Assembly and Method of Fabrication, for which application a Notice of Allowability of Claims was issued Nov. 8, 1988. The patent requested in the parent application has not yet issued.

BACKGROUND OF THE INVENTION (a) Field of the Invention

This invention pertains to a metal sailboat mast assembly.

(b) Description of the Prior Art

Sailboat metal masts of the prior art typically are constructed of a combination of extruded metal sections that are fastened together by rivets or welded together to form the completed mast for the sailboat. U.S. Pat. No. 2,519,230 depicts such a mast constructed of two extruded sections that are riveted together.

A different method for joining the sections together is disclosed in U.S. Pat. No. 4,072,121. The "121" patent uses "C" shaped joining strips which fit over flanges located at the edges of the extruded sections to hold the mast sections together. In operation, however, the joining strips tend to slide up or down the mast and allow the mast sections to move relative to each other thus weakening the structural integrity of the mast.

U.S. Pat. No. 4,211,179 discloses the use of an "H" shaped or a dumb-bell shaped plastic extrusion for joining mast sections together. This construction also suffers from problems associated with the sliding of the mast sections relative to each other.

SUMMARY OF THE INVENTION

The present invention utilizes mirror-symmetrical mast sections having either longitudinal wedge shaped openings or longitudinal wedge shaped edges along each edge of the mast section. Joining sections having mating longitudinal wedge-shaped edges or longitudinal wedge-shaped openings are used to connect the mast sections together. The joining sections and the mast sections are fastened together by glue. After the glue is applied, the sections are pressed together using a partial vacuum either within an enclosing plastic bag or within the sealed mast sections. Because of the wedge shape of the openings and of the joining sections, the pressing together of the mast sections and the joining sections squeezes the glue into a very thin layer uniformly covering the joining surfaces. The thin, uniform layer of glue produces a strong, reliable joint.

Because the mast sections are mirror-symmetrical, a single die can be used to extrude these sections. Also, by use of joining sections of different width, the same mast sections can be used to construct masts having different cross-sections, and hence having different strengths. In addition, by using a uniform wedge shape, the same joining sections can be used with different sized extruded mast sections, all of which leads to lower tooling costs.

DETAILED DESCRIPTION

Figure 1:
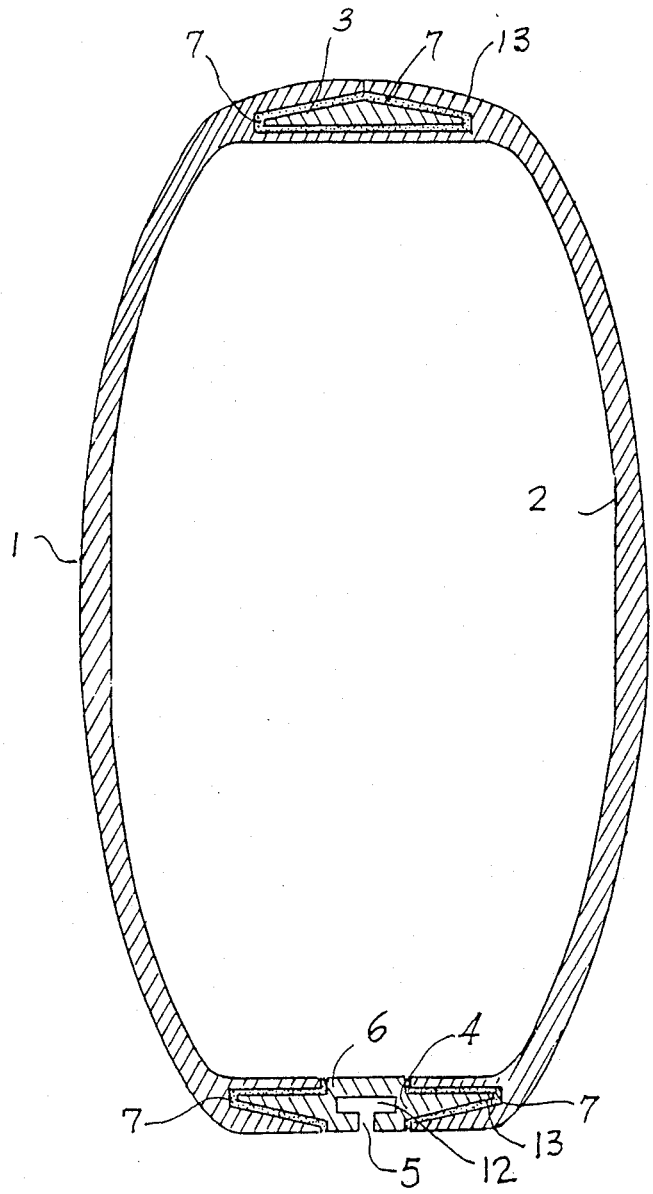
FIG. 1 depicts the cross-section of an assembled mast.

Referring to FIG. 1, mast sections 1 and 2 are joined together by means of joining sections 3 and 4. Mast sections 1 and 2 are mirror-symmetrical and thus can be obtained from a single extrusion, thereby reducing fabrication costs. Although the sections depicted in the figures are mirror-symmetrical, it should be understood that the mast construction and the fabrication method of this invention can also use mast sections that are not mirror-symmetrical.

Joining section 4 also has a longitudinal slot 5 which connects to an interior longitudinal chamber 12 in which the luff of the mainsail may be inserted. Because of the construction of the mast, the size of slot 5 in the completed mast may be altered simply by the use of a joining section 4 having a different sized slot 5.

Surfaces 7 on mast sections 1 and 2 and joining sections 3 and 4 are oriented so as to form longitudinal wedges and longitudinal wedge-shaped openings. In the fabrication process, glue is placed on surfaces 7, the joining sections are set in place and the mast sections are pressed together. The mast sections and the joining sections are pressed together by sealing the ends of the assembly and any other holes in these sections and then creating a partial vacuum within the assembly. Alternatively, the entire assembly can be enclosed within a plastic bag and a partial vacuum created within the bag by pumping out some of the air. Because of the wedge-shaped surfaces, the glue is squeezed into a very thin uniform layer over surfaces 7 and the excess glue is squeezed out of the joints. The thin, uniform layer of glue 13 then provides a strong joint between the joining sections 3 and 4 and the mast sections 1 and 2. A high strength expoxy glue such as Hysol no. EA9430 is suitable for gluing the mast sections together.

Figure 2:
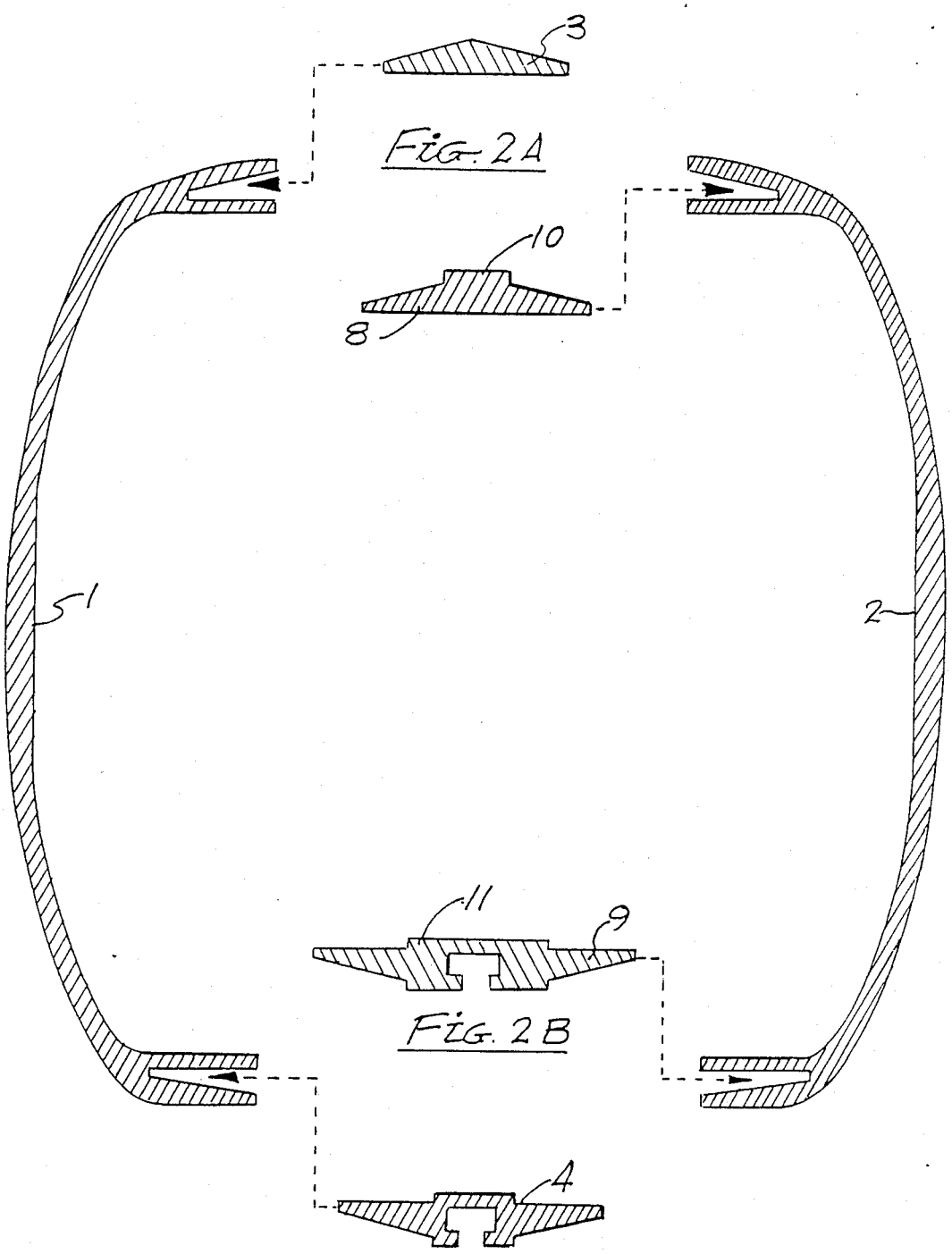
FIG. 2 depicts an "exploded" view of a mast and depicts different joining sections that may be used to assemble the mast.

Referring now to FIG. 2. In addition to the mast sections 1 and 2 and the joining sections 3 and 4 that were depicted in FIG. 1, FIG. 2 also depicts joining sections 8 and 9 that can be used in place of joining sections 3 and 4 to join the same mast sections 1 and 2 together. Joining sections 8 and 9, however, have lengthened center portions 10 and 11 respectively and thus, when joined with mast sections 1 and 2, produce a completed mast assembly having a larger transverse dimension than that obtained by the use of joining sections 3 and 4. Thus, in effect, different sized masts can be fabricated from the same mast sections simply by altering the sizes of the joining sections. Similarly, by fabricating mast sections of different dimensions, but having the same sized wedge-shaped openings, the same joining sections can be used with different mast sections to construct complete masts.

Figure 3:
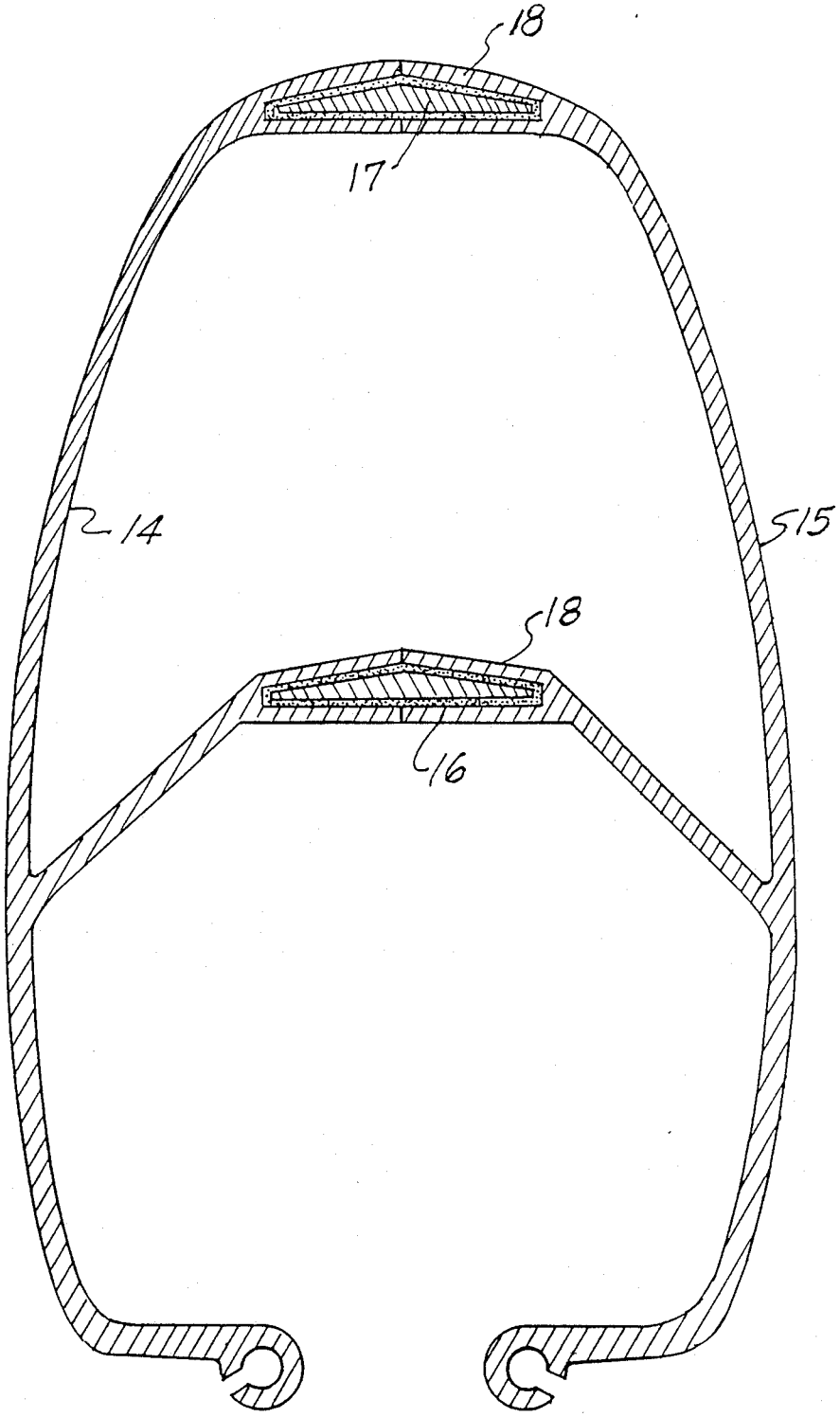
FIG. 3 depicts the cross-section of another mast configuration utilizing the invention.

FIG. 3 depicts the cross-section of a different mast configuration that utilizes the invention. Mast sections 14 and 15 are held together by joining sections 16 and 17 and the glue 18 along the wedge-shaped surfaces of joining sections 16 and 17. A mast having a cross-section such as that depicted in FIG. 3 is used in connection with self-furling sail systems.

Figure 4:
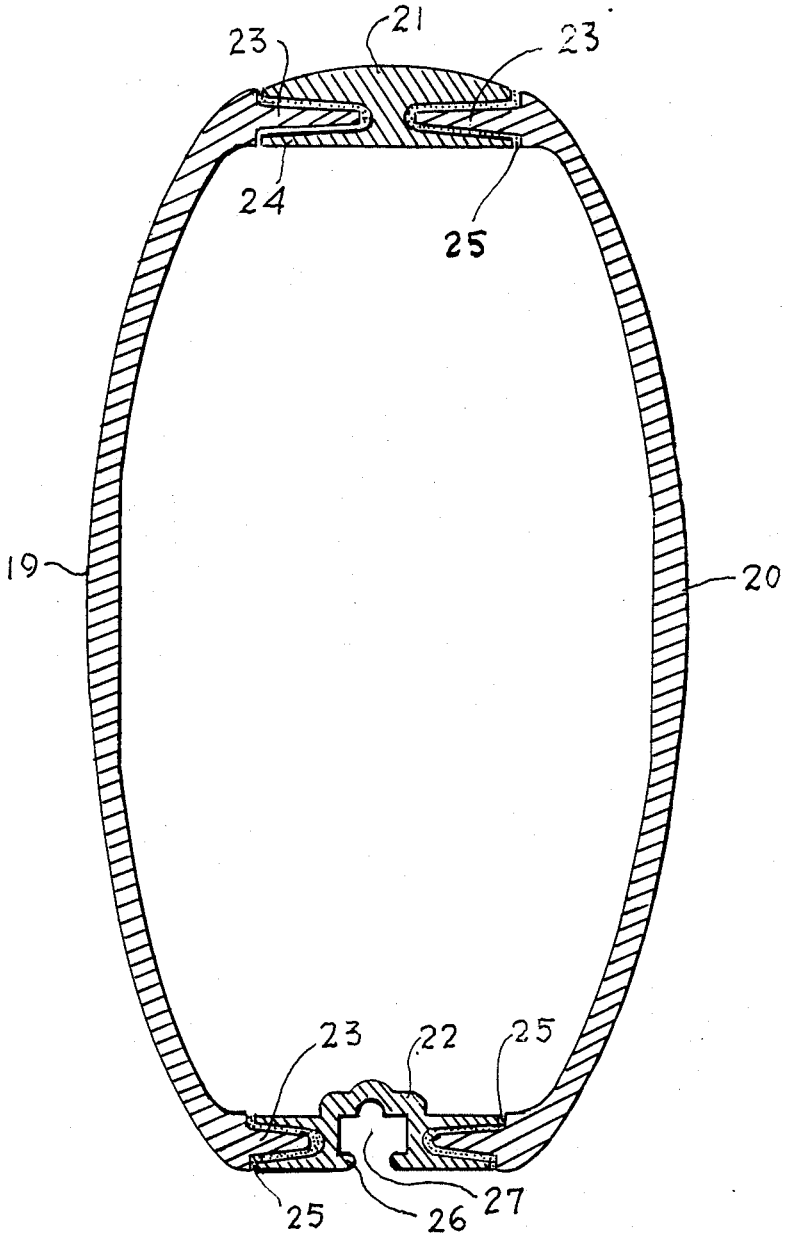
FIG. 4 depicts the cross-section of another mast configuration utilizing the invention.

FIG. 4 depicts the cross-section of a different mast configuration that also utilizes the invention. Mast sections 19 and 20 are joined by means of joining sections 21 and 22. Mast sections 19 and 20 have wedge shaped edges 23 and joining sections 21 and 22 have wedge-shaped openings 24 located at their edges. Mast sections 19 and 20 are held together by joining sections 21 and 22 and the glue 25 along the surfaces of the wedge-shaped openings of mast sections 19 and 20. Joining section 22 additionally has a longitudinal slot 26 which connects to an interior longitudinal chamber 27 in which the luff of a mainsail may be inserted.

From the configurations depicted in FIGS. 1 and 4, it should be apparent that the longitudinal wedge-shaped openings and the longitudinal wedge-shaped edges can be interchanged between the mast sections and the joining sections in any combination that will provide mating surfaces in the assembled mast.

I claim:

1. A sailboat mast comprising first and second mast sections, said first and second mast sections each having two edges and each mast section having longitudinal wedge-shaped surfaces along the two edges, and first and second joining sections, said first and second joining sections each having two edges and having surfaces defining longitudinal wedge-shaped openings along each of the two edges, each wedge-shaped surface of the first and second mast sections being located in one of the wedge-shaped openings at the edge of one of the first and second joining sections so as to form a complete mast, the first and second mast sections and the first and second joining sections being held together by glue located along the wedge-shaped surfaces of the mast sections and the surfaces defining the wedge-shaped openings at the edges of the joining sections, each wedge-shaped surface and the surfaces defining the respective wedge-shaped opening in which each wedge-shaped surface is located cooperating during assembly, in response to pressing together of the first and second mast sections and the first and second joining sections, so as to squeeze said glue, prior to setting of the glue, into a thin layer between each of the wedge-shaped surfaces of the mast sections and each of the surfaces defining the wedge-shaped openings of the joining sections.

2. The device described in claim 1 wherein the second joining section includes a portion thereof defining an interior longitudinal chamber having a longitudinal slot.

3. The device described in claim 1 wherein the first and second mast sections are each mirror-symmetrical within themselves.

4. The device described in claim 2 wherein the first and second mast sections are each mirror-symmetrical within themselves.

5. A sailboat mast comprising first and second mast sections, said first and second mast sections each having at least two longitudinal wedge-shaped surfaces, and first and second joining sections, said first and second joining sections each having two edges and having surfaces defining longitudinal wedge-shaped openings along each of the two edges, each wedge-shaped surface of the first and second mast sections being located in one of the wedge-shaped openings of the first and second joining sections so as to form a complete mast, the first and second mast sections and the first and second joining sections being held together by glue located along the wedge-shaped surfaces of the mast sections and the surfaces defining the wedge-shaped openings of the joining sections, each wedge-shaped surface and the surfaces defining the respective wedge-shaped opening in which each wedge-shaped surface is located cooperating during assembly, in response to pressing together of the first and second mast sections and the first and second joining sections, so as to squeeze said glue, prior to setting of the glue, into a thin layer between each of the wedge-shaped surfaces of the joining sections and each of the surfaces defining the wedge-shaped openings of the mast sections.

6. The device described in claim 5 wherein the first and second mast sections are each mirror-symmetrical within themselves.

7. A sailboat mast comprising first and second mast sections, said first and second mast sections each having two longitudinal mating portions, and first and second joining sections, said first and second joining sections each having first and second edges and each joining section having a longitudinal mating portion located at each of its first and second edges, said longitudinal mating portions being selected from the group of longitudinal mating portions consisting of 1) a longitudinal wedge-shaped surface and 2) surfaces defining a longitudinal wedge-shaped opening, each longitudinal mating portion on the first and second mast sections mating with a longitudinal mating portion on the first and second joining sections so as to form a complete mast, the first and second mast sections and the first and second joining sections being held together by glue located along the wedge-shaped surfaces and the surfaces defining the wedge-shaped openings, each longitudinal wedge-shaped surface and the surfaces defining the respective longitudinal wedge-shaped opening in which each longitudinal wedge-shaped surface is located cooperating during assembly, in response to pressing together of the first and second mast sections and the first and second joining sections, so as to squeeze said glue, prior to setting of the glue, into a thin layer between each of the longitudinal wedge-shaped surfaces and each of the surfaces defining the longitudinal wedge-shaped openings.

8. The device described in claim 7 wherein the second joining section includes a portion thereof defining an interior longitudinal chamber having a longitudinal slot.

* * * * *